US009255690B2

(12) United States Patent
Dimitriadis

(10) Patent No.: US 9,255,690 B2
(45) Date of Patent: Feb. 9, 2016

(54) LUMINAIRE FOR INDOOR HORTICULTURE

(71) Applicant: Thomas C. Dimitriadis, Gardnerville, NV (US)

(72) Inventor: Thomas C. Dimitriadis, Gardnerville, NV (US)

( * ) Notice: Subject to any disclaimer, the term of this patent is extended or adjusted under 35 U.S.C. 154(b) by 471 days.

(21) Appl. No.: 13/631,050

(22) Filed: Sep. 28, 2012

(65) Prior Publication Data

US 2013/0083539 A1 Apr. 4, 2013

Related U.S. Application Data

(60) Provisional application No. 61/626,580, filed on Sep. 29, 2011.

(51) Int. Cl.

| | |
|---|---|
| ***F21V 7/00*** | (2006.01) |
| ***F21V 7/22*** | (2006.01) |
| ***F21V 29/60*** | (2015.01) |
| ***F21V 29/83*** | (2015.01) |

(52) U.S. Cl.

CPC ... *F21V 7/00* (2013.01); *F21V 7/22* (2013.01); *F21V 29/60* (2013.01); *F21V 29/83* (2013.01)

(58) Field of Classification Search

CPC ..... A09G 9/26; A01G 7/045; F21V 15/01; F21V 15/011; F21V 15/012; F21V 15/013; F21V 15/015

USPC ..... 362/297

See application file for complete search history.

(56) References Cited

U.S. PATENT DOCUMENTS

| | | | |
|---|---|---|---|
| 5,069,540 | A | 12/1991 | Gonder |
| 5,733,382 | A | 3/1998 | Hanoka |
| 7,524,090 | B2 | 4/2009 | Hargreaves |
| 7,641,367 | B2 | 1/2010 | Hargreaves et al. |
| 7,852,015 | B1 | 12/2010 | Yen et al. |
| D634,468 | S | 3/2011 | Hargreaves |
| D650,515 | S | 12/2011 | Bradley, Jr. et al. |
| 2007/0227573 | A1 | 10/2007 | Hunter et al. |
| 2011/0002058 | A1 | 1/2011 | Leonhardt |
| 2011/0043092 | A1 | 2/2011 | Shuja et al. |
| 2012/0230035 | A1 | 9/2012 | Bradley, Jr. et al. |

OTHER PUBLICATIONS website: Sunlight Supply, Inc.; Indoor Gardening Supplies, Grow Lights, etc.; Sun System Reflectors, 3 pages www.sunlightsupply.com/c-649-sun-system-reflectors.aspx.

website: Hydrofarm—Raptor—broad light coverage mega reflectors; 2 pages www.hydrofarm.com/our-brands/raptor.php.

*Primary Examiner* — Andrew Coughlin

(74) *Attorney, Agent, or Firm* — Whitaker Chalk Swindle & Schwartz PLLC; Stephen S. Mosher

(57) ABSTRACT

A reflector hood for a luminaire having a lamp in an upper portion thereof and first and second air flow ducts formed in first and second opposite sides of said reflector hood for ventilation. First and second secondary reflecting panels are respectively disposed within the hood over and spaced a predetermined distance from each first and second air flow duct such that light emitted by the lamp is reflected from said reflecting panels instead of passing through the first and second air flow ducts.

16 Claims, 7 Drawing Sheets

FIG. 7

LUMINAIRE FOR INDOOR HORTICULTURE

CROSS REFERENCE TO RELATED APPLICATION

The present application claims priority from the earlier filed provisional application Ser. No. 61/626,580, filed Sep. 29, 2011, entitled "Sun Simulating Luminaire (lighting fixture) for Indoor Horticulture, by the same inventor.

BACKGROUND OF THE INVENTION

1. Field of the Invention

The present invention generally relates to indoor lighting fixtures and more specifically to a reflector design for luminaires used in indoor horticulture.

2. Background of the Invention and Description of the Prior Art

Indoor horticulture requires exposure of plants to a light source that matches the characteristics of sunlight in both spectral and intensity aspects. These aspects should preferably be provided by sources that are as efficient as possible to conserve energy and avoid harm to the plants. Moreover, the choice of light source and design features of the reflector portions of the luminaire must be balanced against the outputs of available sources that emit wavelengths and intensities that may depart from the preferred radiation of the sun.

Prior art luminaires for use in indoor horticulture are typically made of aluminum or steel, painted to provide a reflective surface, employ high intensity, broad-spectrum lamps, and provide for forced cooling by ducting air through the luminaire from one end to the other. Steel is heavier than aluminum, and painted surfaces that require an extra step in manufacture provide only moderate reflectivity for use in light fixtures such as the luminaires used in indoor horticulture. Further, while the inlet/outlet ducts of this arrangement can indeed remove heat emitted by the lamp, the area of the duct openings, which pass through a substantial portion of the reflecting surface, is lost thereby reducing the effective reflecting area of the reflector portion of the luminaire. Moreover, there is typically no provision for controlling the air flow path through the luminaire to gain maximum efficiency of ventilation to reduce the amount of heat radiated into the plants.

Other attributes of conventional designs is the need to remove the glass lens to access the lamp assembly to replace the lamp, an inconvenient operation at best. Additionally, in the typical luminaire, the glass lens, though tempered for safety, is typically soda lime glass that is inexpensive but has less than optimum transparency.

The foregoing characteristics of conventional luminaires used for indoor horticulture result in reduced efficiencies in operation. What is needed is a luminaire design that overcomes these deficiencies.

SUMMARY OF THE INVENTION

Accordingly a reflector for a luminaire is disclosed, in one embodiment, comprising a rectangular hood-like exterior shell for a luminaire having first and second air flow ducts formed in first and second opposite sides of the shell, wherein the luminaire includes a lamp supported in an upper interior portion thereof; and first and second secondary reflecting panels respectively disposed within the shell over and spaced a predetermined distance from each first and second air flow duct such that light emitted by the lamp is reflected from the reflecting panels instead of passing through the first and second air flow ducts.

In one aspect of the invention a rectangular top opening is provided for access to the lamp assembly. The opening is covered with a top cover assembly hinged at one end thereof. An upper reflector having first and second upward-inclined sides joined at a first included angle is attached to the underside of said top cover assembly, along with a lamp bracket supporting a lamp socket.

In another aspect a low-iron glass lens having high transparency is secured to the perimeter of said exterior shell with an air-tight seal along corresponding outer edges thereof.

In another embodiment, a ventilated reflector for an indoor luminaire is disclosed, comprising: a rectangular exterior shell formed of a first sheet material having downward-inclined first and second sides and first and second ends and a rectangular top opening covered with a top cover assembly hinged at one end thereof to one of the first and second ends; an upper reflector formed of a second sheet material having first and second upward-inclined sides joined at a first included angle and attached to the underside of the top cover assembly, the first angle disposed parallel to and below a first longitudinal centerline of the top cover; a lamp bracket supported beneath the top cover near the hinged end, the bracket supporting a lamp socket oriented along a second centerline parallel with and below the first longitudinal centerline of the top cover; first and second side reflector panels formed of the second sheet material and attached to an underside of each side of the exterior shell and spaced a predetermined uniform spacing therefrom; and first and second duct openings centrally disposed in each of the first and second sides of the exterior shell.

DETAILED DESCRIPTION OF THE INVENTION

Figure 1:
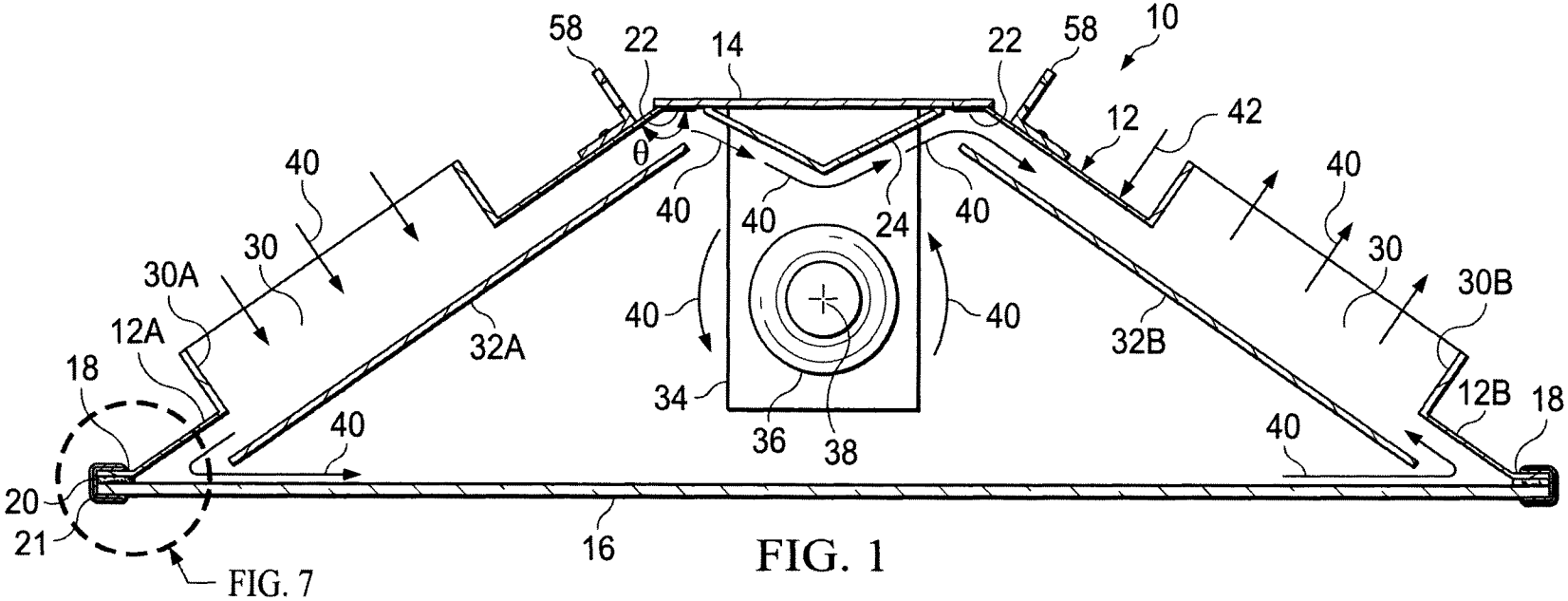
FIG. 1 illustrates a simplified end view cross section of the reflector assembly of one embodiment of the invention, taken along the longitudinal axis of the reflector assembly.

In an advance in the state of the art of luminaires for indoor horticulture the description of the invention herein below, read in conjunction with the included drawings, describes a ventilated reflector for an indoor luminaire or lighting fixture having novel ventilation and illumination features that provide improved utility and efficiency in operation. The embodiment described is intended to be illustrative of the principles employed to achieve the benefits of the improved design, and is not intended to be limiting of the scope of the invention. These principles may be applied to luminaires in a variety of applications and sizes without departing from the basic concept as described. In the several views provided in the drawings, structures bearing the same reference numbers are the same structural feature.

The embodiments of the invention described herein and set forth in the appended claims provide full reflecting surfaces within the full internal area of the exterior shell, a low iron glass lens that presents minimum impediment to the light radiated by the lamp assembly, and includes a hinged access cover for ready access to the lamp assembly for replacement and service. The result is a luminaire having superior illumination performance that operates with less heat build-up and greater efficiency.

FIG. 1 illustrates a simplified end view cross section of the reflector assembly of the luminaire of the present invention along the longitudinal axis 38 of one embodiment of the luminaire. The reflector assembly may also be called a hood. Arrows 40 in the figure depict the paths of air flow through the reflector assembly of the luminaire 10. Luminaire 10 is constructed of an exterior shell 12 fabricated of a first sheet material. Exterior shell 12 includes first and second sides 12A, 12B, and first and second ends 12C, 12D (not shown in FIG. 1, but see FIGS. 2 and 4) and a top cover 14. In the illustrated embodiment the angle of inclination θ (FIG. 1) of the first and second side reflectors and the horizontal is approximately 41°, and the angle of inclination ϕ (FIG. 2) of the first and second end reflectors and the horizontal is approximately 35°. These angles may vary up to ±5 degrees without serious degradation of performance.

Figure 2:
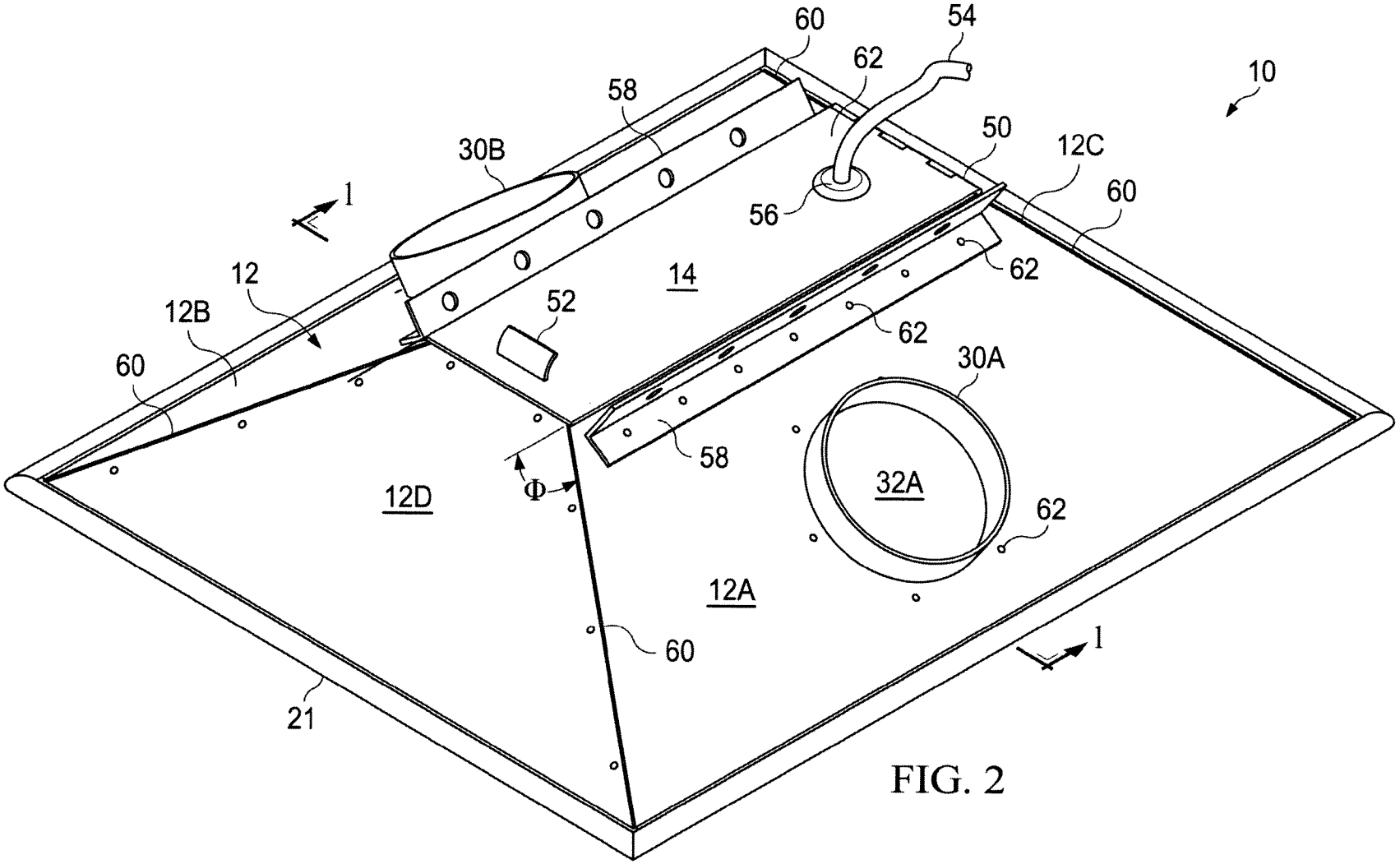
FIG. 2 illustrates a pictorial view of the embodiment of FIG. 1.

As will be described, the top cover 14 is hinged at one end (see FIGS. 2 and 3) to one end of an opening formed by the innermost edges 22 of the sides 12A, 12B and the ends 12C, 12D. Also attached to the underside of the top cover 14 is an upper reflector panel 24, fabricated of a second sheet material. The upper reflector panel 24, which may be constructed of 0.020 inch mirror finish stucco aluminum sheet in this preferred illustrated embodiment, may be attached to the underside of the top cover 14 using rivets 62 as shown in FIG. 2 below. The sides 12A, 12B and ends 12C, 12D of the exterior shell 12 may fabricated of a first sheet material, generally a metal sheet having a thickness of approximately 0.040 inch or equivalent. In this illustrated embodiment, the first sheet material is preferably 0.040 clear anodized aluminum. Other light weight sheet materials may be used if they meet the fabrication and cost considerations and include a suitable reflective finish.

Figure 7:
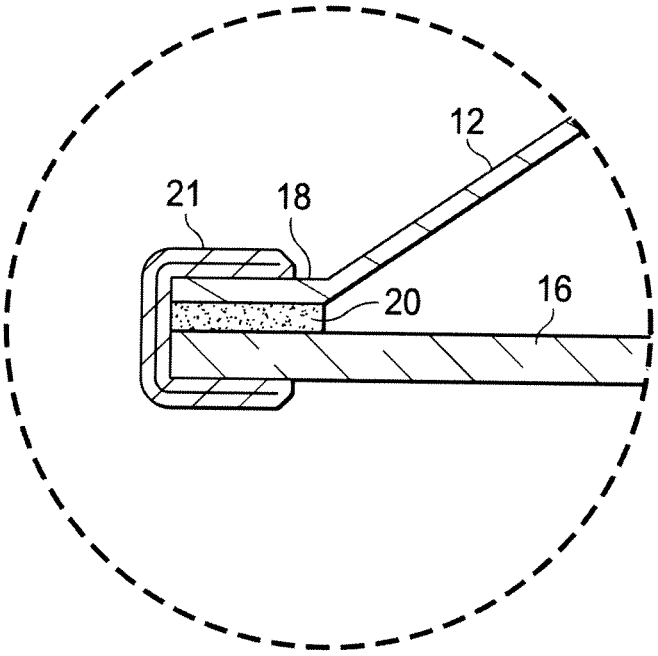
FIG. 7 illustrates a detail view of the edges of the exterior shell and glass lens of the embodiment of FIG. 1.

A glass lens 16 encloses the bottom of the exterior shell 12. The edges of the glass lens 16 may be secured to the corresponding edges 18 of the sides 12A, 12B and ends 12C, 12D of the exterior shell 12 using vinyl foam tape as a gasket 20 between the edges of the glass lens 16 and the exterior shell 12. An edge trim 21 is then installed over and along the combined edges to secure them together as shown in detail in FIG. 7. This structure extends around the entire perimeter of the exterior shell 12 and the glass lens 16, to provide an air-tight seal. In the illustrated embodiment the vinyl foam tape, preferably 0.75 inch wide and 0.125 inch thick, forms the gasket 20. The preferred edge trim 21 may be a type no. 1375B7K5/16, available at www.trimlok.com. This product, designed for this particular type of application, is a channel-shaped strip product fabricated of PVC (polyvinyl chloride) material and having U-shaped, staple-like elements embedded within the PVC material to reinforce the material and provide spring tension to act as a clamping device when it is installed along the edges of sheet materials to be secured together. This product may include other features to ensure that it remains in position on the edges to be secured. While other methods of securing the glass lens 16 to the edges 18 of the exterior shell 12 may be used, the structure illustrated provides a full-perimeter, air-tight seal around the edges of the reflector assembly.

Continuing with FIG. 1, shown in cross section are first 30A and second 30B ducts formed by openings 30 in the first and second sides 12A, 12B that permit air to flow through the first and second sides 12A, 12B as indicated by the arrows 40. The air flow 40, generally provided by external fans and capable of moving air at the rate of 200 to 400 CFM (cubic feet per minute) through the luminaire 10, is directed by first 32A and second 32B side reflector panels that are attached to the inside surfaces of the first and second sides 12A, 12B and first and second ends 12C, 12D of the exterior shell 12. 200 CFM is adequate for smaller 600 Watt luminaires; 400 CFM may be needed for up to three of the larger 1000 Watt luminaires operated with a single forced air system.

First and second side reflector panels 32A, 32B are preferably fabricated of the second sheet material such as 0.020 inch mirror finish stucco aluminum in the illustrated embodiment. The mirror finish provides superior reflectivity as compared to the standard grade of stucco aluminum. Other sheet material may be used as long as the design goals can be efficiently and economically met. The use of light weight aluminum throughout the construction of the present invention results in a durable but light weight structure. For example, other sheet metal products are usually much heavier and require additional steps to provide a durable and pleasing finish, as well as satisfying the requirement of high reflectivity to the light wave lengths emitted by the lamp 36. The first and second side reflectors 32A, 32B will generally be the same length as the first and second sides 12A, 12B but have a width dimension that is preferably approximately one to two inches less than the width of the first and second sides 12A, 12B, so that the minimum vertical dimension between the lower edge of the first and second side reflectors and the glass lens 16 is at least 0.50 inch.

Figure 4:
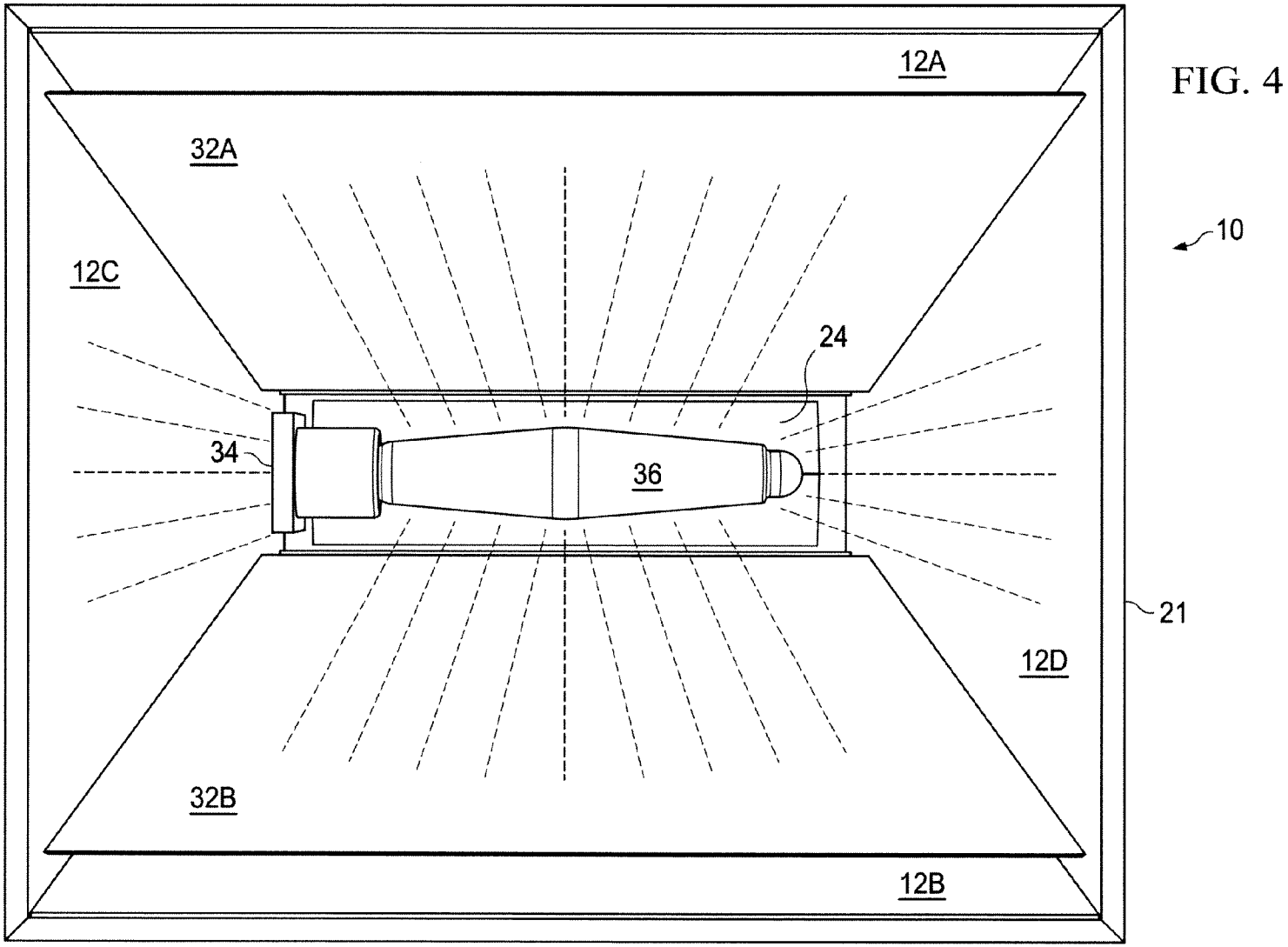
FIG. 4 illustrates a view of the embodiment of FIG. 1 from below the reflector assembly showing the relationship of the lamp assembly and the internal reflecting surfaces.
Figure 5:
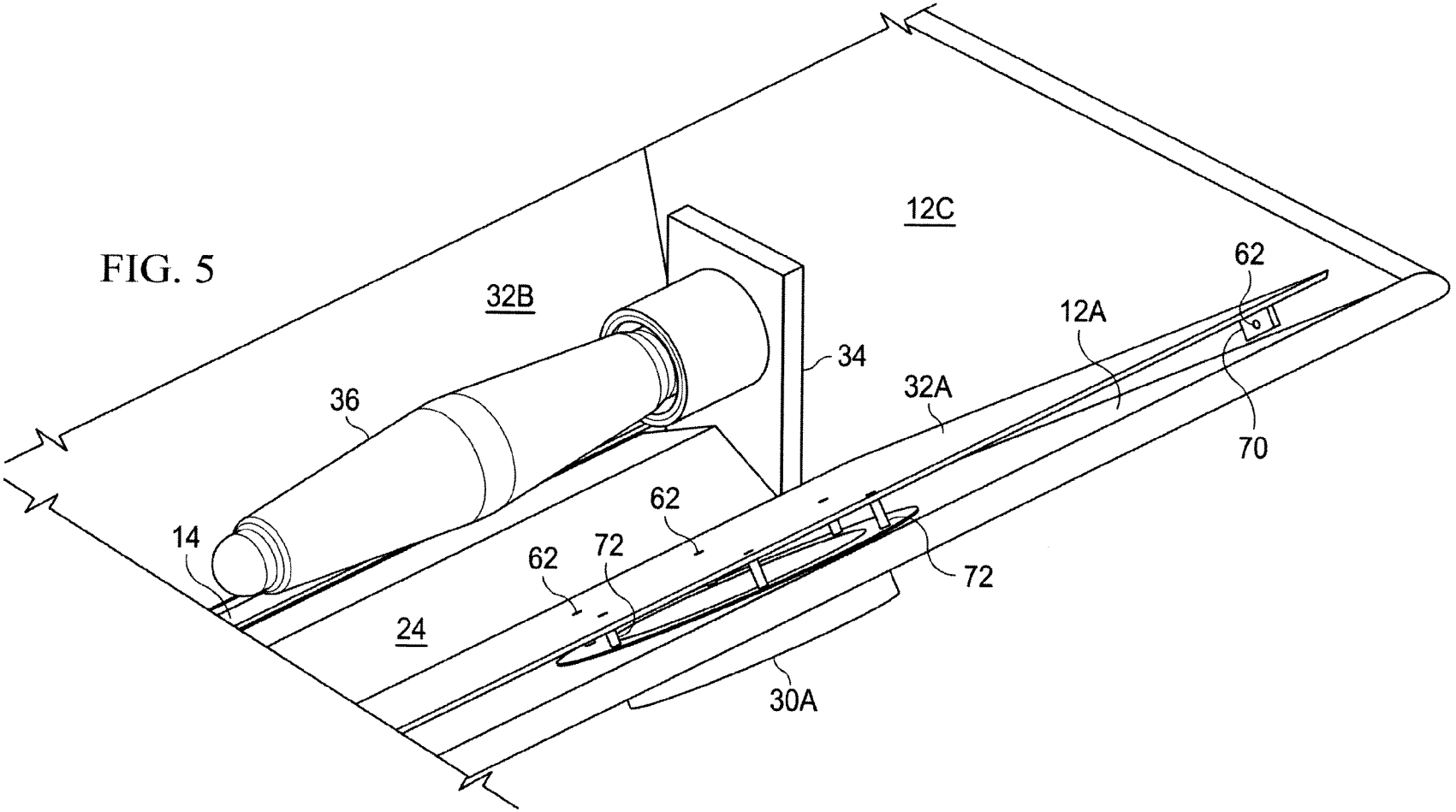
FIG. 5 illustrates a detail view of the attachment of internal side reflector panels to the exterior shell of the embodiment of FIG. 1.

The attachment methods for securing the sides and side reflectors are described in FIG. 5. The first and second 32A, 32B side reflector panels are spaced away (spacing 42) from the underside of the sides of the exterior shell by 0.75 inch in a preferred embodiment, although this spacing 42 may be varied to adapt to specific applications. Generally, this spacing should be great enough to permit the required volume of air passing through the cross sectional area of the ducts 30A, 30B to flow through the space as indicated by the arrows 40 with minimal restriction. As noted, the minimum vertical distance between the lower edge of the first and second side reflectors and the glass lens 16 should be at least 0.50 inch. Supported from the underside of the top cover 14, which may also be fabricated from the first sheet material or from 0.040 clear anodized aluminum, is a lamp bracket 34, which supports a lamp assembly 36, seen in FIG. 1 in an end view. The lamp bracket 34 and lamp 36 are described below in FIG. 6, and also shown in FIGS. 3 and 4.

FIG. 1 illustrates a basic concept embodied in the invention that is heretofore not present in the prior art, namely, the combination of forced air ventilation through the ducting as depicted and the provision of maximum reflection of the light energy from essentially 100% of the interior surface area of the luminaire 10. This is because the fully reflective first and second side reflector panels 32A and 32B cover the duct openings 30 and direct the air flow 40 around the side reflector panels 32A and 32B. This directed air flow 40, provided by fans external to the luminaire 10 thus provides complete, efficient removal of heated air from the vicinity of the lamp 36. Conventional forced air luminaires—also called "reflectors" in the industry, have significantly less than 100% reflection because their air ducts in opposite ends of the exterior shell are simply openings in the end panels. Light from the lamp in these conventional luminaires or "reflectors" passes through the open duct and is thus not available for being utilized by the plants illuminated by the lighting fixture. The cross sectional area of each of the duct openings is typically 30 square inches to 50 square inches or more, which represents a substantial portion of the inside surface area of the reflector that could be used for reflecting the light energy. Further, the duct openings impair the ability of the reflector to provide a uniform pattern of illumination that may result in less than sufficient light output for the plants. Uneven illumination can be a significant problem in indoor horticulture. The present invention overcomes this problem.

FIG. 2 illustrates a pictorial view of the embodiment of FIG. 1, looking down from above the luminaire 10. The sides 12A, 12B and ends 12C, 12D of the exterior shell 12 are shown, along with the top cover 14, the foam tape 20, the first and second ducts 30A, 30B, and, visible through first duct 30A is a portion of the first side reflector panel 32A. The sides 12A, 12B and ends 12C, 12D are fastened together in the illustrated embodiment at the seams 60 using rivets 62. A latch 52 is shown near the end of the top cover 14 opposite the hinge 50 that attaches the top cover 14 to the exterior shell 12. A power cord 54 is shown connected to a power connector 56 that is attached to the lamp bracket 34 to enable the required electrical connections to a lamp socket 82 (FIG. 6) for operating the lamp 36. The power cord 54 and electrical connections 56 are conventional and well known in the art; accordingly they are not further described herein. Also shown are mounting brackets 58, one on each side adjacent the top cover 14, secured to the exterior shell 12 using rivets 62. Holes 64 may be provided in the mounting brackets 58 to attach wire, hooks, or chains to support the luminaire 10 in the required position.

Figure 3:
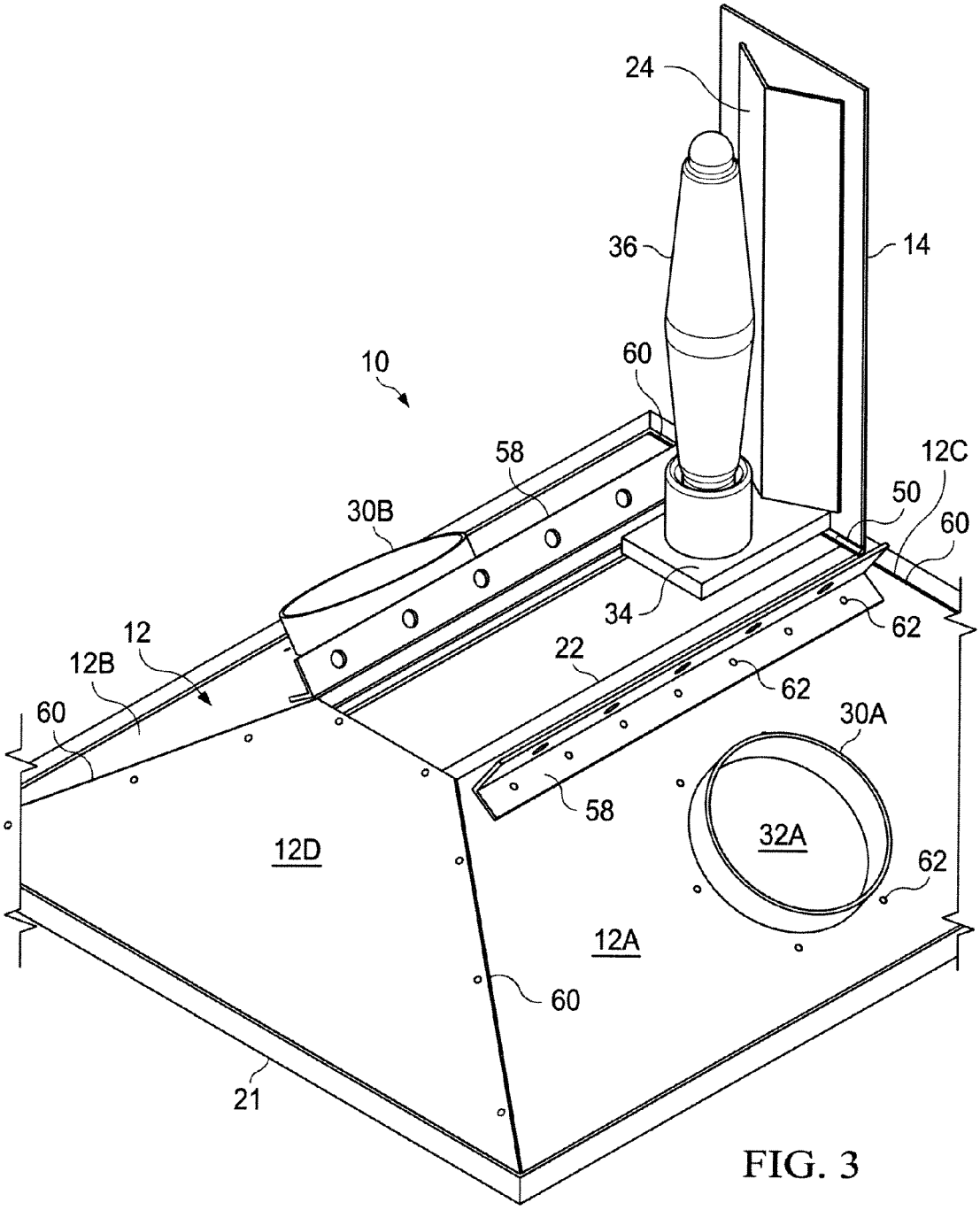
FIG. 3 illustrates a second pictorial view of the embodiment of FIG. 1 with a top cover opened.

FIG. 3 illustrates a second pictorial view of the embodiment of FIG. 1 with a top cover 14 opened to show the lamp assembly structure. The top cover 14, when opened by operation of the latch 52 (FIG. 2) enables convenient access to the lamp assembly to replace the lamp 36 by raising the top cover 14 as it pivots on the hinge 50. The lamp 36 is replaced by unscrewing the lamp 36 from the type E39 Mogul socket 82 that is mounted on the lamp bracket 34 and installing a replacement lamp 36 in the socket 82. Lamp bracket 34 may preferably be an enclosed box to enclose the wiring of the power cord connector 56 to the socket 82. Further, the upper reflector panel 24 is shown disposed between the underside of the top cover 14 and the lamp 36. The upper reflector panel 24 in the illustrated embodiment may be bent to an included angle of approximately 120° to enable reflection of light from the lamp 36 that is directed upward from the lamp 36. This angle may vary depending on the spacing of the lamp 36 from the upper reflector panel 24 and other dimensions of the luminaire 10. The upper reflector panel reflects light from the upper side of the lamp 36 in a direction downward and away from the lamp 36, thereby helping to provide a more uniform illumination pattern as will be apparent from studying FIGS. 1 and 4.

Luminaires 10 of the type illustrated herein may be readily adapted to various sizes and light output wattages. For example, two convenient wattage ratings are 600 Watt and 1000 Watt. In the 600 Watt model, the lamps used are typically 600 Watt HPS (high pressure sodium) or 600 Watt MH (metal halide) types. In the 1000 Watt models a 1000 Watt Dual Arc lamp may be used. Each of these lamps provides a balanced illumination spectrum that simulates natural sunlight and is thus well suited for indoor horticulture. In the embodiment described herein the physical size of the luminaire is larger for the 1000 Watt unit, typically having overall dimensions of approximately 42 inches long×35 inches wide×9 inches high. The dimensions of a 600 Watt unit may be 28×21×6 inches. The air ducts 30A, 30B for a 1000 Watt unit may be nominally 8 inches in diameter; and 6 inches in diameter for the 600 Watt unit.

FIG. 4 illustrates a view of the embodiment of FIG. 1 looking upward from below the reflector assembly when the luminaire is operative showing the relationship of the lamp assembly and the internal reflecting surfaces. The figure reveals how the light is reflected from the mirror finish stucco aluminum of the first and second ends 12C, 12D and side reflectors 32A, 32B, and the upper reflector panel 24. It is important to observe that virtually all of the internal surfaces of the reflector or luminaire 10 are available for reflecting the light output of the lamp 36. Thus nearly 100% of the reflected light is radiated toward the plants positioned below the luminaire 10.

FIG. 5 illustrates a detail view of the attachment of the internal first and second side reflectors 32A, 32B to the exterior shell of the embodiment of FIG. 1. The view in this figure is obliquely along one underside edge of the luminaire 10 with the glass lens 16 removed to expose the attachment of the side reflector 32A to the exterior shell 12. The side reflector 32A is attached to side 12C at a tab 70 using a rivet 62, for example. The side reflector 32A is also supported by stand-off spacers 72 placed between the side reflector 32A and the side 12A as shown. The tabs 70 and the spacers 72 are used at additional locations not visible in the view of FIG. 5. In general, the tabs 70 may be used at the corners of the first and second side reflectors 32A, 32B and the spacers 72 placed at, for example, four equally-spaced positions around the perimeter of the duct openings 30. The spacers 72 may be secured using screws or rivets 62 as shown. A portion of duct 30A appears between the side reflector 32A and the side 12A in the view depicted in FIG. 5.

Figure 6:
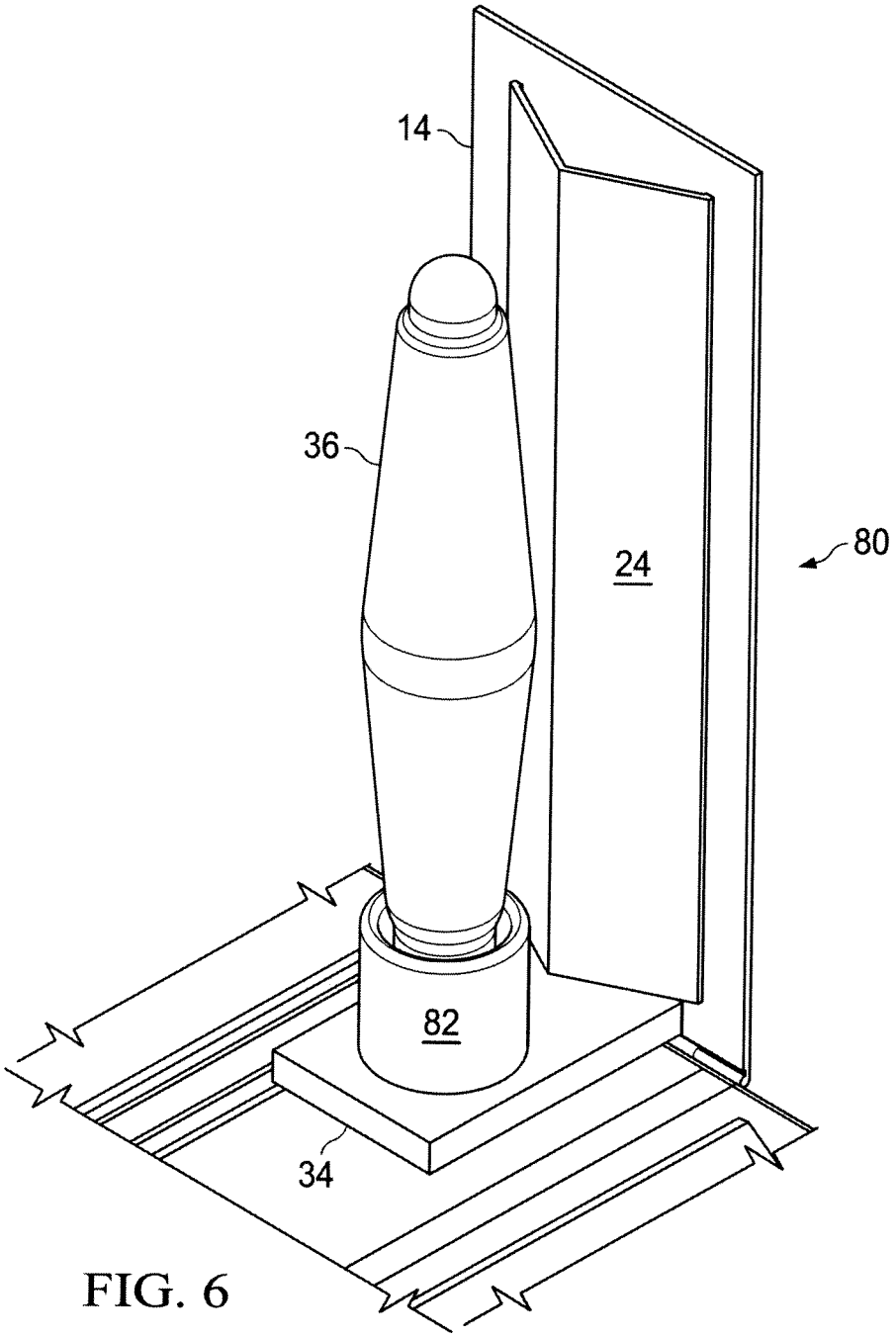
FIG. 6 illustrates a detail view of the lamp and top cover assemblies of the embodiment of FIG. 1.

FIG. 6 illustrates a detail view of the lamp and top cover assemblies of the embodiment of FIG. 1. The top cover 14 is shown at the left side of the figure in an open position for servicing the lamp 36. The upper reflector panel 24 is shown attached to the underside of the top cover and disposed between the underside of the top cover 14 and the lamp 36. The lamp 36 is shown installed in the socket 82, which is mounted in the lamp bracket 34. As described herein above, the lamp bracket 34 may be a box-like structure that houses wiring for the lamp socket 82 and the power cord connector 56 shown in FIG. 2. As also previously described, several types of lamps 36 may be used with the luminaire of the present invention. These include HPS (high pressure sodium), MH (metal halide), and dual arc lamps that may include both types of light-producing elements. All of these types may be conveniently socketed in a screw-type E39 Mogul lamp base, a standard socket type in the industry.

While the invention has been shown in only one of its forms, it is not thus limited but is susceptible to various changes and modifications without departing from the spirit thereof.

What is claimed is:

1. A ventilated reflector for an indoor luminaire, comprising:

a rectangular exterior shell formed of a first sheet material having downward-inclined first and second sides and first and second ends and a rectangular top opening covered with a top cover assembly hinged at one end thereof to one of said first and second ends;

an upper reflector formed of a second sheet material having first and second upward-inclined sides joined at a first included angle and attached to the underside of said top cover assembly, said first angle disposed parallel to and below a first longitudinal centerline of said top cover;

a lamp bracket supported beneath said top cover near said hinged end, said bracket supporting a lamp socket oriented along a second centerline parallel with and below said first longitudinal centerline of said top cover;

first and second side reflector panels formed of said second sheet material and attached to an underside of each said side of said exterior shell and spaced a predetermined uniform spacing therefrom;

first and second duct openings centrally disposed in each of said first and second sides of said exterior shell;

a low-iron glass lens secured to the perimeter of said exterior shell with an air-tight seal along corresponding outer edges thereof provided by a vinyl foam tape gasket disposed between said corresponding outer edges of said exterior shell and said glass lens; and a flexible, channel-shaped, metal reinforced PVC edge trim strip disposed over corresponding outer edges of said exterior shell, said glass lens, and said gasket disposed therebetween.

2. The reflector of claim 1, wherein said first sheet material is clear anodized aluminum sheet.

3. The reflector of claim 2, wherein said clear anodized aluminum sheet is approximately 0.040 inch thick.

4. The reflector of claim 1, wherein said second sheet material is a mirror finish stucco aluminum sheet.

5. The reflector of claim 4, wherein said mirror finish stucco aluminum sheet is approximately 0.020 inch thick.

6. The reflector of claim 1, further comprising:

a lamp installed in said lamp socket and selected from the group consisting of metal halide, high pressure sodium, and a full spectrum dual arc lamps.

7. The reflector of claim 1, wherein said lamp socket comprises:

a type E39 mogul base.

8. The reflector of claim 1, wherein further:

the angle of inclination of said first and second sides from horizontal is approximately 41 degrees±5 degrees; and the angle of inclination of said first and second ends from horizontal is approximately 35 degrees±5 degrees.

9. The reflector of claim 1, wherein the angle of inclination of said sides of said upper reflector from horizontal is approximately 30 degrees and said first included angle is approximately 120 degrees.

10. The reflector of claim 1, wherein the cross sectional area of each said duct opening is at least 30 square inches.

11. The reflector of claim 1, wherein said predetermined uniform spacing of said side reflector panels from said underside of said exterior shell is at least 0.50 inch.

12. The reflector of claim 1, wherein said predetermined uniform spacing of said side reflector panels from said underside of said exterior shell is approximately 0.75 inch.

13. The reflector of claim 1, wherein:

the minimum vertical dimension between the lower edge of said first and second side reflectors and said glass lens is at least 0.50 inch.

14. The reflector of claim 1, further comprising:

a detachable connector for connecting electrical supply to said mogul lamp base.

15. The reflector of claim 1, further comprising:

first and second mounting brackets attached to an upper outside surface of said exterior shell.

16. The reflector of claim 1, wherein the cross sectional area of each said duct opening is at least 40 square inches.

* * * * *